US005643048A

United States Patent [19]

Iyer

[11] Patent Number: 5,643,048

[45] Date of Patent: Jul. 1, 1997

[54] ENDPOINT REGULATOR AND METHOD FOR REGULATING A CHANGE IN WAFER THICKNESS IN CHEMICAL-MECHANICAL PLANARIZATION OF SEMICONDUCTOR WAFERS

[75] Inventor: Ravi Iyer, Boise, Id.

[73] Assignee: Micron Technology, Inc., Boise, Id.

[21] Appl. No.: 600,461

[22] Filed: Feb. 13, 1996

[51] Int. Cl.[6] ..... B24B 37/04

[52] U.S. Cl. ..... 451/6; 451/285; 451/288; 451/289; 156/626.1; 156/645.1

[58] Field of Search ..... 451/6, 9, 41, 285, 451/287, 288, 289; 156/626.1, 627.1, 645.1

[56] References Cited

U.S. PATENT DOCUMENTS

| | | | |
|---|---|---|---|
| 4,519,168 | 5/1985 | Cesna | 451/288 |
| 4,860,498 | 8/1989 | Gosis | 451/288 |
| 5,069,002 | 12/1991 | Sandhu et al. | 451/41 |
| 5,081,796 | 1/1992 | Schultz | 451/41 |
| 5,191,738 | 3/1993 | Nakazato et al. | 51/283 R |
| 5,245,794 | 9/1993 | Salugsugan | 451/287 |
| 5,413,941 | 5/1995 | Koos et al. . | |
| 5,422,316 | 6/1995 | Desai et al. | 437/228 |
| 5,433,650 | 7/1995 | Winebarger | 451/287 |

*Primary Examiner*—Willis Little
*Assistant Examiner*—Eileen P. Morgan
*Attorney, Agent, or Firm*—Seed and Berry LLP

[57] ABSTRACT

The present invention is an endpoint regulator that controls the endpoint in chemical-mechanical planarization of a semiconductor wafer on a polishing pad. The endpoint regulator has a chuck with a mounting surface to which the wafer is attachable, and a spacer connected to the chuck around the periphery of the wafer. The spacer has a polish-stop face that extends axially downwardly with respect to the mounting surface; at least one of the polish-stop face or the wafer mounting surface is selectively spaceable with respect to the other to space the polish-stop face apart from the mounting surface by a distance equal to a desired post-planarization thickness of the wafer. In operation, the polish-stop face engages the polishing pad when the wafer is polished to the desired thickness to substantially prevent further planarization of the wafer. To selectively change the desired endpoint of a wafer, the spacer is either interchanged with a different spacer or adjusted to move the polish-stop face with respect to the mounting surface.

31 Claims, 6 Drawing Sheets

ENDPOINT REGULATOR AND METHOD FOR REGULATING A CHANGE IN WAFER THICKNESS IN CHEMICAL-MECHANICAL PLANARIZATION OF SEMICONDUCTOR WAFERS

TECHNICAL FIELD

The present invention relates to an endpoint regulator and a method for accurately regulating a change in thickness of a semiconductor wafer during chemical-mechanical planarization of the wafer.

BACKGROUND OF THE INVENTION

Chemical-mechanical planarization ("CMP") processes remove material from the surface of a wafer in the production of ultra-high density integrated circuits. In a typical CMP process, a wafer is pressed against a polishing pad in the presence of a slurry under controlled chemical, pressure, velocity, and temperature conditions. The slurry solution generally contains small, abrasive particles that abrade the surface of the wafer, and chemicals that etch and/or oxidize the surface of the wafer. The polishing pad is generally a planar pad made from a relatively soft, porous material such as blown polyurethane. Thus, when the pad and/or the wafer moves with respect to the other, material is removed from the surface of the wafer by the abrasive particles (mechanical removal) and by the chemicals in the slurry (chemical removal).

FIG. 1 schematically illustrates a conventional CMP machine 10 with a platen 20, a wafer carrier 30, a polishing pad 40, and a slurry 44 on the polishing pad. The platen 20 has a surface 22 upon which the polishing pad 40 is positioned. A drive assembly 26 rotates the platen 20 as indicated by arrow "A" and/or reciprocates the platen back and forth as indicated by arrow "B". The motion of the platen 20 is imparted to the pad 40 because the polishing pad 40 frictionally engages the surface 22 of the platen 20. The wafer carrier 30 has a lower surface 32 to which a wafer 60 may be attached, or the wafer 60 may be attached to a resilient pad 34 positioned between the wafer 60 and the lower surface 32. The wafer carrier 30 may be a weighted, free-floating wafer carrier, or an actuator assembly 36 may be attached to the wafer carrier 30 to impart axial and rotational motion, as indicated by arrows "C" and "D", respectively.

In the operation of the conventional planarizer 10, the wafer 60 is positioned face-downward against the polishing pad 40, and then the platen 20 and the wafer carrier 30 move relative to one another. As the face of the wafer 60 moves across the planarizing surface 42 of the polishing pad 40, the polishing pad 40 and the slurry 44 remove material from the wafer 60.

In the competitive semiconductor industry, it is highly desirable to maximize the throughput of CMP processes to produce accurate, planar surfaces as quickly as possible. The throughput of CMP processes is a function of several factors, one of which is the ability to accurately stop the CMP process at a desired endpoint. Accurately stopping the CMP process at a desired endpoint is important to maintaining a high throughput because the thickness of the dielectric layer must be within an acceptable range; if the thickness of the dielectric layer is not within an acceptable range, the wafer must be re-planarized until it reaches the desired endpoint. Thus, it is highly desirable to stop the CMP process at the desired endpoint.

In one conventional method for regulating the endpoint of the CMP process, the polishing period of one wafer in a run is estimated using the polishing rate of previous wafers in the run. The estimated polishing period for the wafer, however, may not be accurate because the polishing rate may change from one wafer to another. Thus, this method may not accurately planarize the wafer to the desired endpoint.

U.S. Pat. No. 5,422,316 to Desai et al. discloses a multi-wafer carrier with a polishing limiting device. The wafer carrier is a support plate with a plurality of circular recesses that hold semiconductor wafers, and the polishing limiter is the top of the support plate. The thickness of the polishing limiter (the axial distance between the bottom of the recesses and the top of the support plate) is equal to the predetermined final thickness of the wafer. The thickness of the polishing limiter is less then initial thickness of the wafers, and thus the wafers are reduced to a final thickness approximately equal to the axial distance between the wafer holding surface and the top of the support plate. One problem with the apparatus disclosed in U.S. Pat. No. 5,422,316 is that the distance between the wafer holding surfaces and the top of the support plate is fixed. Because the desired final thickness of one run of wafers may be different than another, either several separate polishers are required to fabricate different types of devices, or completely different wafer carriers must be installed in the planarizing machine between runs of wafers. Thus, the polisher disclosed in U.S. Pat. No. 5,422,316 is difficult and costly to operate for processes that planarize different wafers to different thicknesses.

In a method for measuring the endpoint of the CMP process, the wafer is removed from the pad and wafer carrier, and then the thickness of the wafer is measured. Removing the wafer from the pad and wafer carrier, however, is time-consuming and may damage the wafer. Moreover, if the wafer is not at the desired endpoint, then even more time is required to re-mount the wafer to the wafer carrier for repolishing. Thus, this method generally reduces the throughput of the CMP process.

In another method for measuring the endpoint of the CMP process, a portion of the wafer is moved beyond the edge of the pad, and an interferometer directs a beam of light directly onto the exposed portion of the wafer. The wafer, however, may not be in the same reference position each time it overhangs the pad because the edge of the pad is compressible, the wafer may pivot when it overhangs the pad, and the exposed portion of the wafer may vary from one measurement to the next. Thus, this method may inaccurately measure the change in thickness of the wafer.

In light of the problems with conventional endpoint regulators and methods for measuring the endpoint, it would be desirable to develop an apparatus and a method that selectively regulates the post-planarization thickness of a wafer.

SUMMARY OF THE INVENTION

The inventive endpoint regulator controls the endpoint in chemical-mechanical planarization of a semiconductor wafer on a polishing pad. The endpoint regulator has a chuck and a spacer. The chuck has a mounting surface to which the wafer is attachable, and the spacer is connected to the chuck around the periphery of the wafer. The spacer has a polish-stop face that extends axially downwardly with respect to the mounting surface; at least one of the polish-stop face or the wafer mounting surface is selectively spaceable with respect to the other to selectively space the polish-stop face apart from the mounting surface by a distance equal to a desired post-planarization thickness of the wafer. In operation, the polish-stop face engages the polishing pad when the wafer is polished to the desired thickness to substantially prevent further planarization of the wafer. To selectively change the desired endpoint, the spacer is either interchanged with a different spacer or adjusted to move the polish-stop face with respect to the mounting surface.

DETAILED DESCRIPTION OF THE INVENTION

The present invention is an endpoint regulator that selectively controls the post-polishing endpoint thickness of a wafer in CMP processes. An important aspect of the invention is that it provides a spacer that prevents the polishing pad from planarizing a wafer past the desired post-polishing endpoint thickness of the wafer. A central aspect of the invention is that the spacer is selectively spaceable so that a single planarizing machine can planarize different runs of wafers to different desired post-polishing endpoint thicknesses without estimating planarization times, removing and installing complete wafer carrier assemblies, or measuring the change in thickness of the wafer. Thus, the endpoint regulator of the present invention selectively regulates the post-polishing thickness of a wafer.

Figure 1:
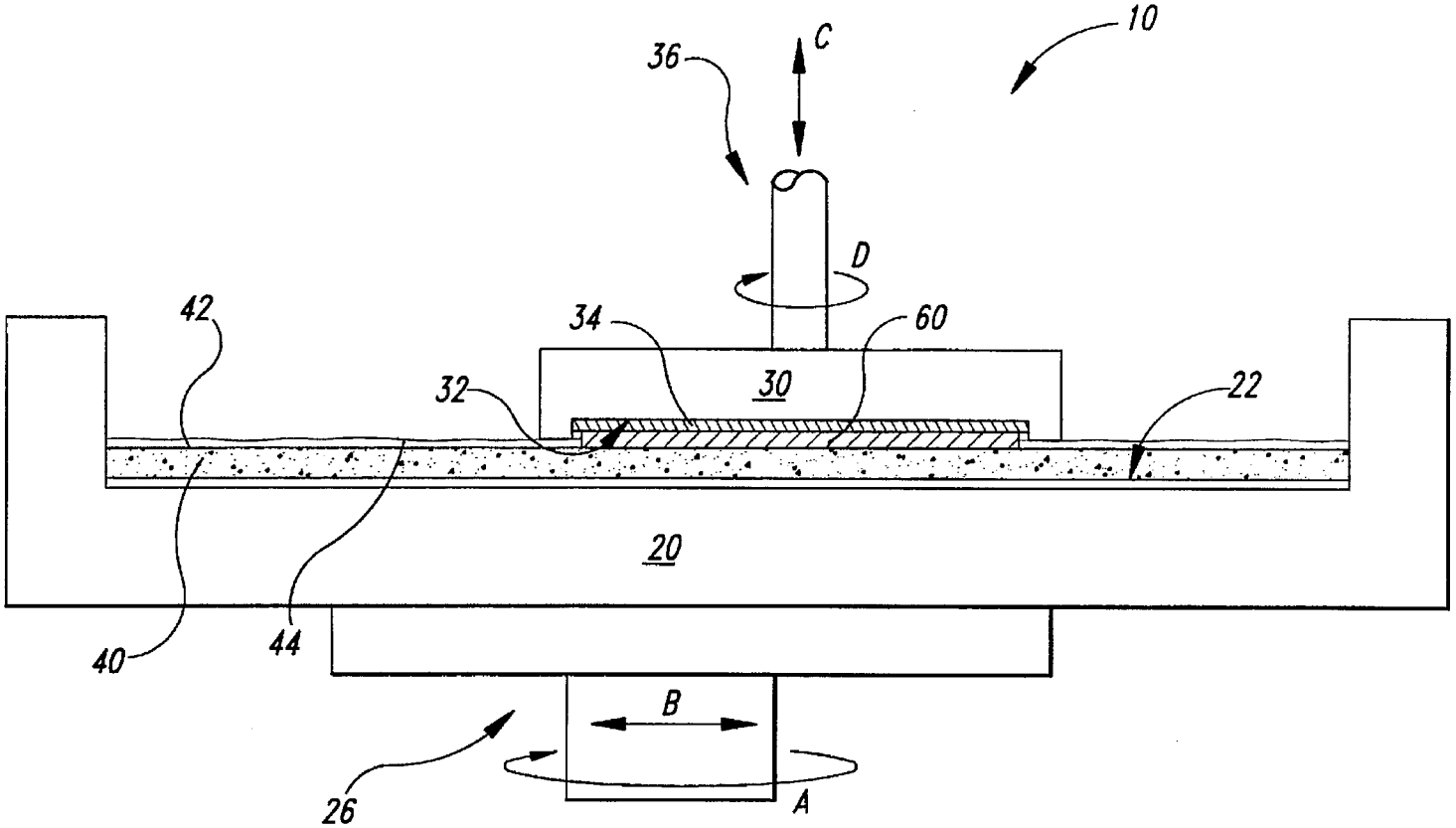
Fig. 1 (Prior Art)
FIG. 1 is a schematic cross-sectional view of a conventional chemical-mechanical planarizing machine in accordance with the prior art.
Figure 2:
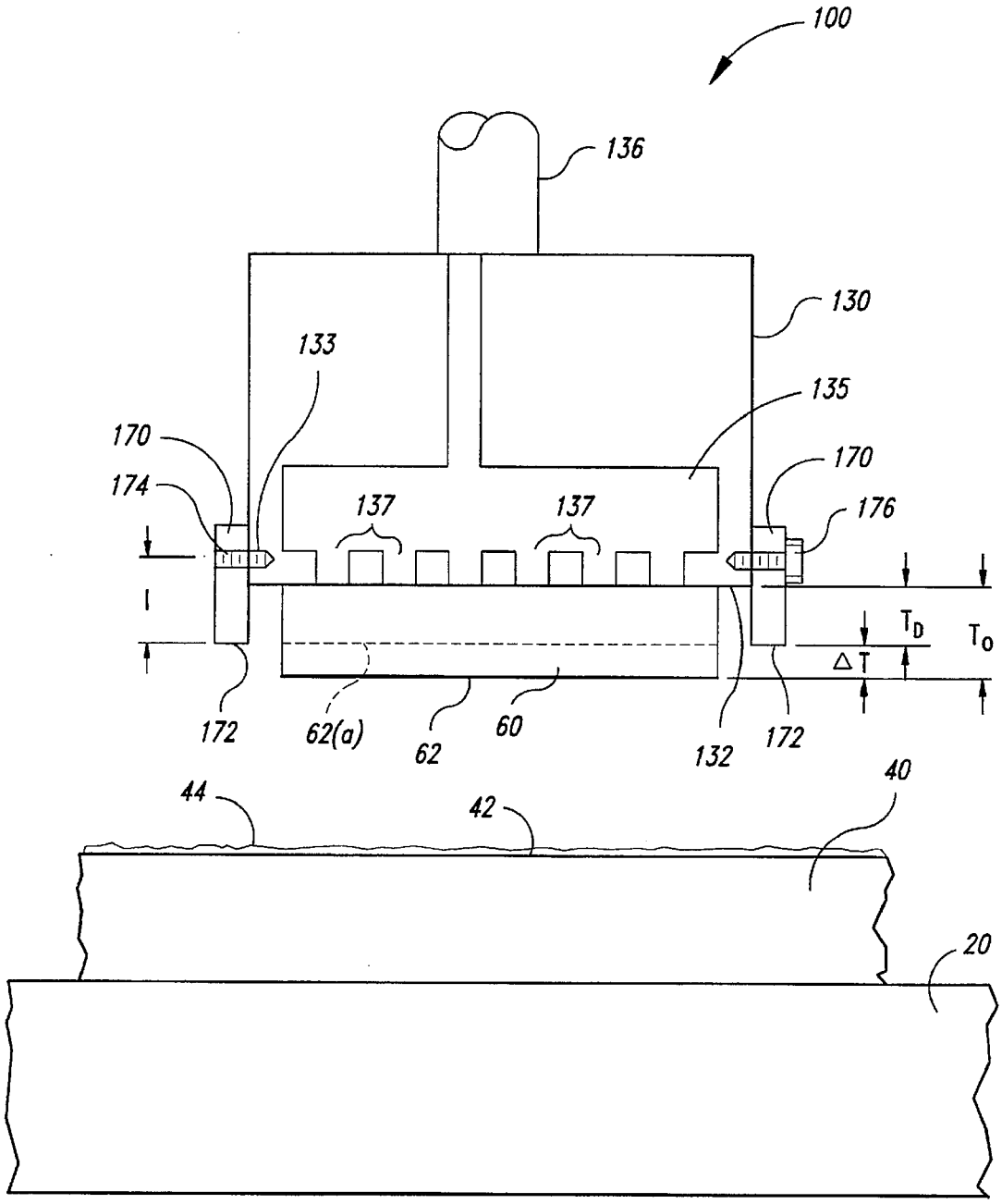
FIG. 2 is a schematic cross-sectional view of an endpoint regulator in accordance with the invention.

FIG. 2 illustrates an endpoint regulator 100 that has a chuck 130 to which a spacer 170 is attached around its periphery. The chuck 130 and spacer 170 are preferably both circular in plan view, although not apparent from the cross-sectional view of FIG. 2. The chuck 130 is preferably the wafer carrier, but it may be a separate unit that is attachable to the wafer carrier. When the chuck 130 is the wafer carrier, a number of vacuum channels 137 extend between a vacuum plenum 135 and a wafer mounting surface 132. An actuator 136 is attached to the chuck 130 to translate and rotate the chuck 130 across the polishing pad 40, and a number of guidepoints 133 are positioned around the perimeter of the chuck 130 proximate to the wafer mounting surface 132. A vacuum drawn in the vacuum plenum 135 and through channels 137 attaches the wafer 60 to the mounting surface 132. When the chuck is a separate unit (not shown), the vacuum plenum, vacuum channels, and actuator are components of the wafer carrier. A separate unit chuck, accordingly, provides fluid communication between the wafer carrier and the wafer so that the vacuum acts against the wafer.

The spacer 170 is a removably attachable ring with a polish-stop face 172 and a number of reference points 174. The reference points 174 align with the guidepoints 133 to properly position the spacer 170 on the chuck 130. The reference points 174 and guidepoints 133 are preferably threaded holes through which bolts 176 are inserted to attach the spacer 170 to the chuck 130. The polish-stop face 172 on the spacer 170 is positioned from the reference point 174 by an axial distance l; importantly, the spacer 170 is one of a set of interchangeable spacers in which the axial distance l is different for each spacer. The spacer 170 is made from a hard, polish-resistant material, such as hardened steel.

In operation, a spacer 170 with an appropriate axial length l is selected to space the polish-stop surface 172 apart from the wafer mounting surface 132 by the desired post-planarization thickness $T_D$. The spacer 170 is attached to the chuck 130, and the wafer 60 is mounted to the wafer mounting surface 132. The original thickness $T_O$ of the wafer 60 is the axial distance between the mounting surface 132 and the unplanarized surface 62 of the wafer 60. The desired change in thickness $\Delta T$ of the wafer 60 is accordingly the axial distance between the polish-stop face 172 and the unplanarized surface 62 of the wafer 60. The chuck 130 is then moved axially downwardly to engage the unplanarized surface 62 of the wafer 60 with the planarizing surface 42 of the polishing pad 40. As the wafer and/or polishing pad moves with respect to the other, the polishing pad 40 and slurry 44 remove material from the wafer 60 until the polish-stop face 172 of the spacer 170 engages the planarizing surface 42 of the polishing pad 40. The polish-stop face 172 substantially prevents further removal of material from the wafer 60 because the pad 40 and slurry 44 are substantially prevented from engaging the surface of the wafer. Once the polish-stop face 172 engages the planarizing surface 42 of the pad 40, the chuck 130 is moved axially upwardly to disengage the planarized surface 62(*a*) from the planarizing surface 42. The thickness of the resulting wafer 60 is accordingly equal to the desired thickness $T_D$.

One advantage of the endpoint regulator 100 is that it provides a definite, consistent endpoint without estimating planarization times, removing and installing complete wafer carrier assemblies, or physically measuring the change in thickness of the wafer several times throughout the CMP process. Since the spacer 170 may be readily interchanged with other spacers that have different axial lengths l, the desired post-planarization thickness $T_D$ may be varied from one run of wafers to another by simply interchanging one spacer with another spacer that has an appropriate axial length. A single planarizing machine with the endpoint regulator 100, for example, can planarize a first run of wafers to one desired post-planarization thickness with a spacer having an axial length $l_1$. The planarizing machine can then planarize a second run of wafers to another post-planarization thickness with another spacer having an axial length $l_2$. Accordingly, the endpoint regulator 100 is highly accurate and versatile.

Figure 3:
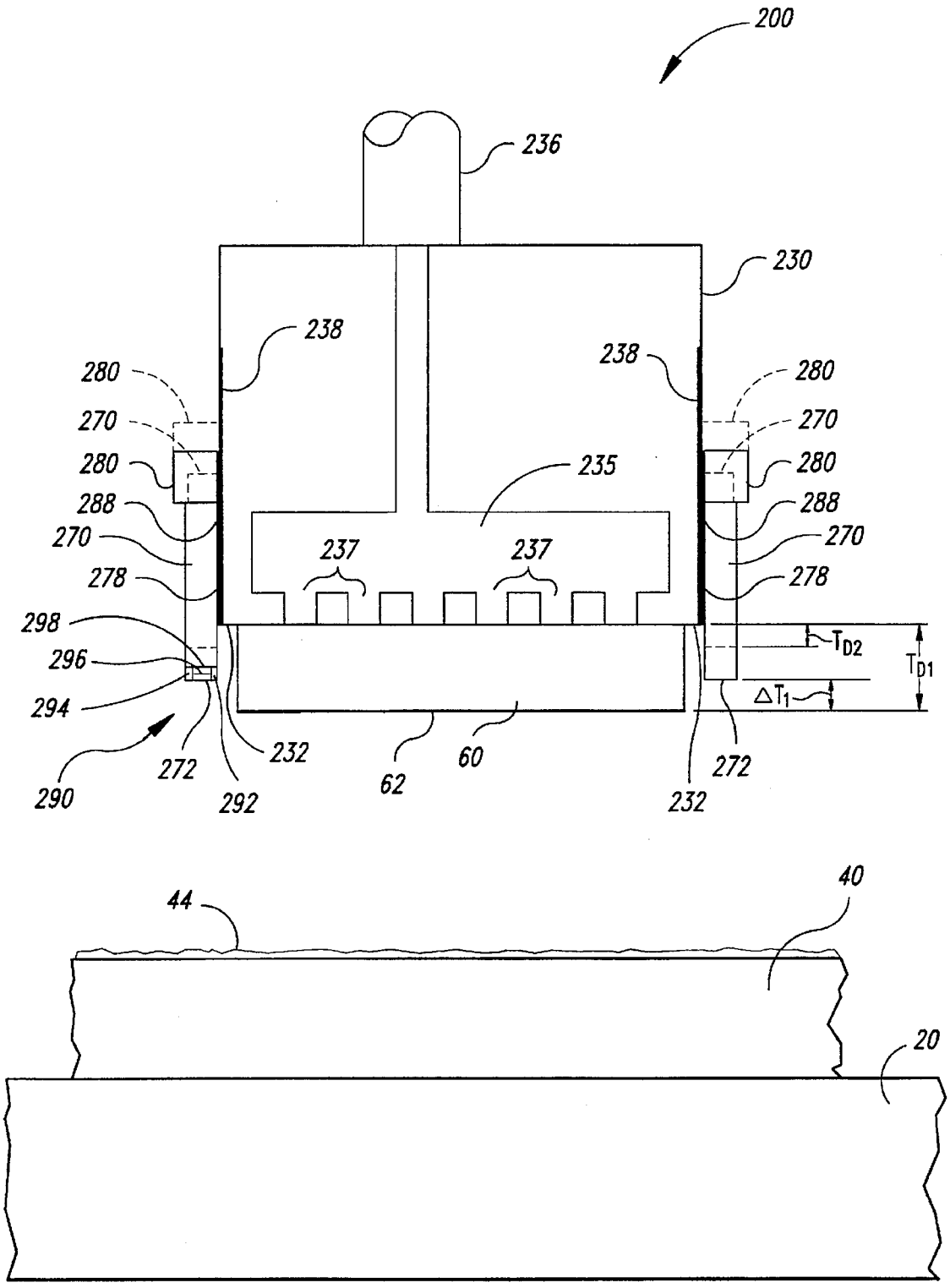
FIG. 3 is a schematic cross-sectional view of another endpoint regulator in accordance with the invention.

FIG. 3 illustrates another endpoint regulator 200 in accordance with the invention. The endpoint regulator 200 has a chuck 230 and an axially adjustable spacer 270 with a polish-stop face 272. The spacer 270 is preferably a sleeve that fits over the perimeter of the chuck 230. As described above with respect to the endpoint regulator 100 shown in FIG. 2, the chuck 230 has a vacuum plenum 235, a number of vacuum channels 237, an actuator 236, and a wafer mounting face 232. The chuck 230 has threads 238 formed in its outer surface, and the spacer 270 has mating threads 278 formed on its inner surface that engage the threads 238 of the chuck 230. The spacer 270 moves parallel to the longitudinal axis of the chuck 230 as it rotates with respect to the chuck 230. A locking-ring 280 with threads 288 formed on its inner surface is also threadedly engaged with the threads 238 on the chuck 230. The locking-ring 280 is selectively positionable to stop the spacer 270 in a position in which the polish-stop face 272 is spaced away from the wafer mounting surface 232 by a distance equal to the desired post-planarization thickness of the wafer 60.

In a preferred embodiment, a sensor 290 is positioned at the polish-stop face 272 to sense when the polish-stop face 272 engages the polishing pad 40. In one embodiment, the sensor 290 is a light emitter 292 and a light detector 294 positioned in a shallow channel 298 in the polish-stop face 272. The light emitter 292 directs a beam of light 296 through the channel 298 to the light detector 294. When the polish-stop face 272 engages the pad 40, the slurry 44 interrupts the light beam 296 and causes the detector 294 to either illuminate or shut-off. Other suitable sensors 290 include a current meter coupled to the motor of the wafer carrier that indicates the load on the motor caused by the friction between the polish-stop face 272 and the pad 40, and a pair of electrical terminals that pass a current through the slurry.

In operation, the axially adjustable spacer 270 rotates about the chuck 230 to position the polish-stop face 272 apart from the wafer mounting surface 232 by a distance equal to the desired post-planarization thickness of the wafer. For example, to planarize a wafer to a desired post-planarization thickness of $T_{D1}$, the spacer 70 rotates about the chuck 230 until the polish-stop face 272 is spaced apart from the wafer mounting surface 232 by an axial distance equal to $T_{D1}$. To move the spacer 270 so that the polish-stop face 272 is spaced apart from the wafer mounting surface 232 by an axial distance equal to $T_{D2}$, the locking-ring 280 is rotated until it is positioned axially higher along the chuck 230 (shown in phantom) and the spacer 270 is rotated until it engages the locking-ring 280 (shown in phantom). The second run of wafers is then planarized to a post-planarization thickness of $T_{D2}$.

One advantage of the endpoint regulator 200 is that the endpoint control may be changed quickly and accurately without removing the spacer 270 from the chuck 230. The threads 238, 278, and 288 are formed at a predetermined pitch, and thus the axial displacement of the spacer 270 and locking-ring 280 is controlled by rotating the spacer 270 and locking ring 280 a desired number of rotations to achieve the desired axial displacement. Accordingly, the adjustable spacer 270 accurately positions the polish-stop face 172 with respect to the wafer mounting surface 232 in a short period of time.

Figure 4:
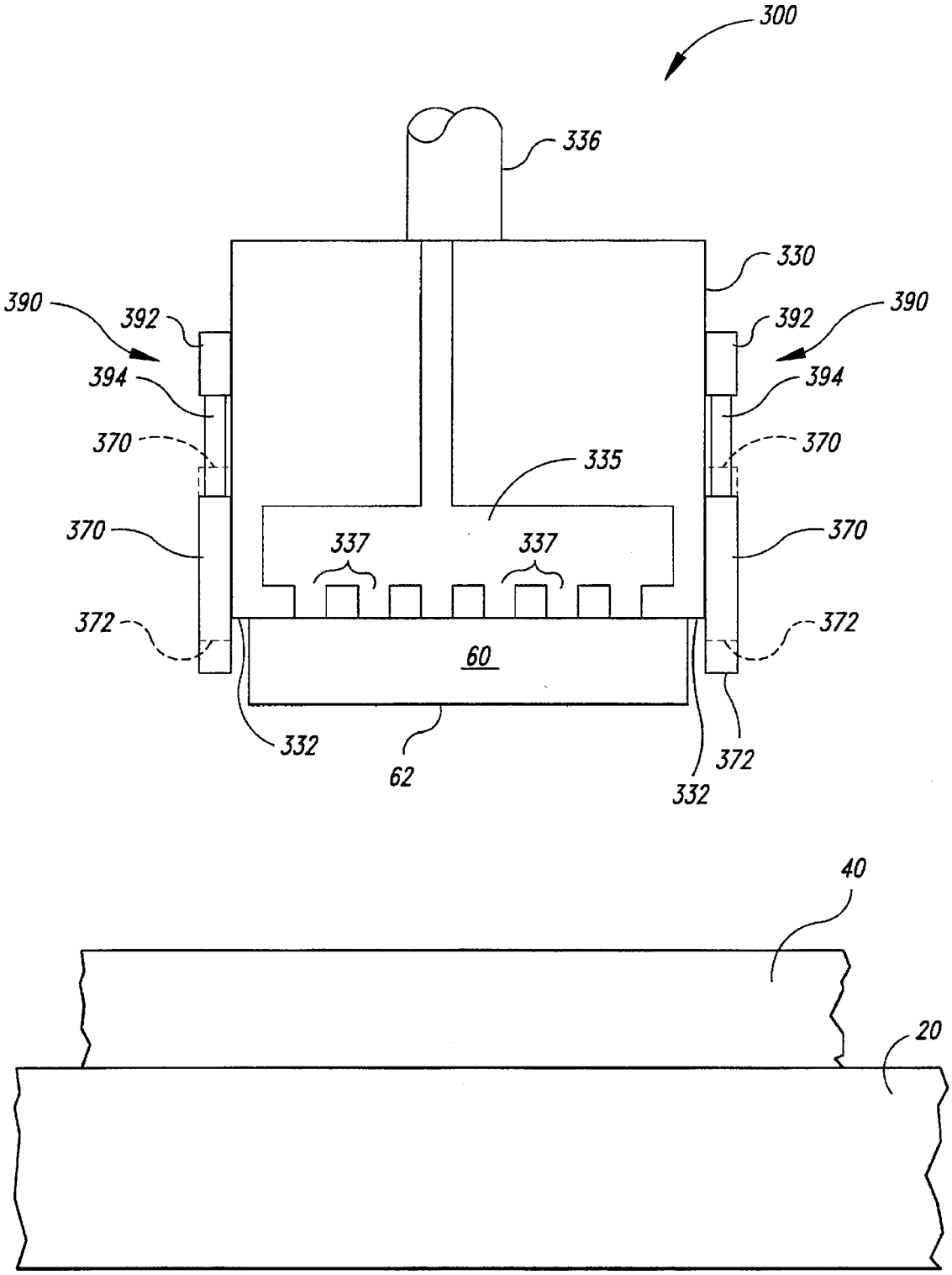
FIG. 4 is a schematic cross-sectional view of another endpoint regulator in accordance with the invention.

FIG. 4 illustrates another endpoint regulator 300 that has a chuck 330 and an axially adjustable spacer 370 with a polish-stop face 372. An actuator 390 is attached to the outer surface of the chuck 330 to axially slide the spacer 370 over the outer surface of the chuck 330. The actuator 390 has a housing 392 attached to the chuck 330 and a rod 394 connected to the spacer 370. The rod 394 moves axially with respect to the chuck 330 to axially move the spacer 370 over the chuck 330. In a preferred embodiment, the actuator 390 is electric and the rod 394 is a threaded member threadedly engaged with either the housing 392 or the spacer 370. The actuator 390 may also be a hydraulic cylinder or a pneumatic cylinder. The endpoint regulator 300 works in the same manner as the endpoint regulator 200 described above with respect to FIG. 3. The wafer 60 is mounted to the wafer mounting surface 332 under the influence of a vacuum drawn in a vacuum plenum 335 and channels 337. To planarize a wafer to a first desired post-planarization thickness, the polish-stop face 372 of the spacer 370 is spaced apart from the wafer mounting surface 332 by a distance that is equal to the desired post-planarization thickness of the wafer. If the post-planarization thickness changes from one wafer to another, the actuator 390 axially moves the spacer 370 over the chuck 330 to position the polish-stop face 372 at a different axial distance from the wafer mounting surface 332.

Figure 5:
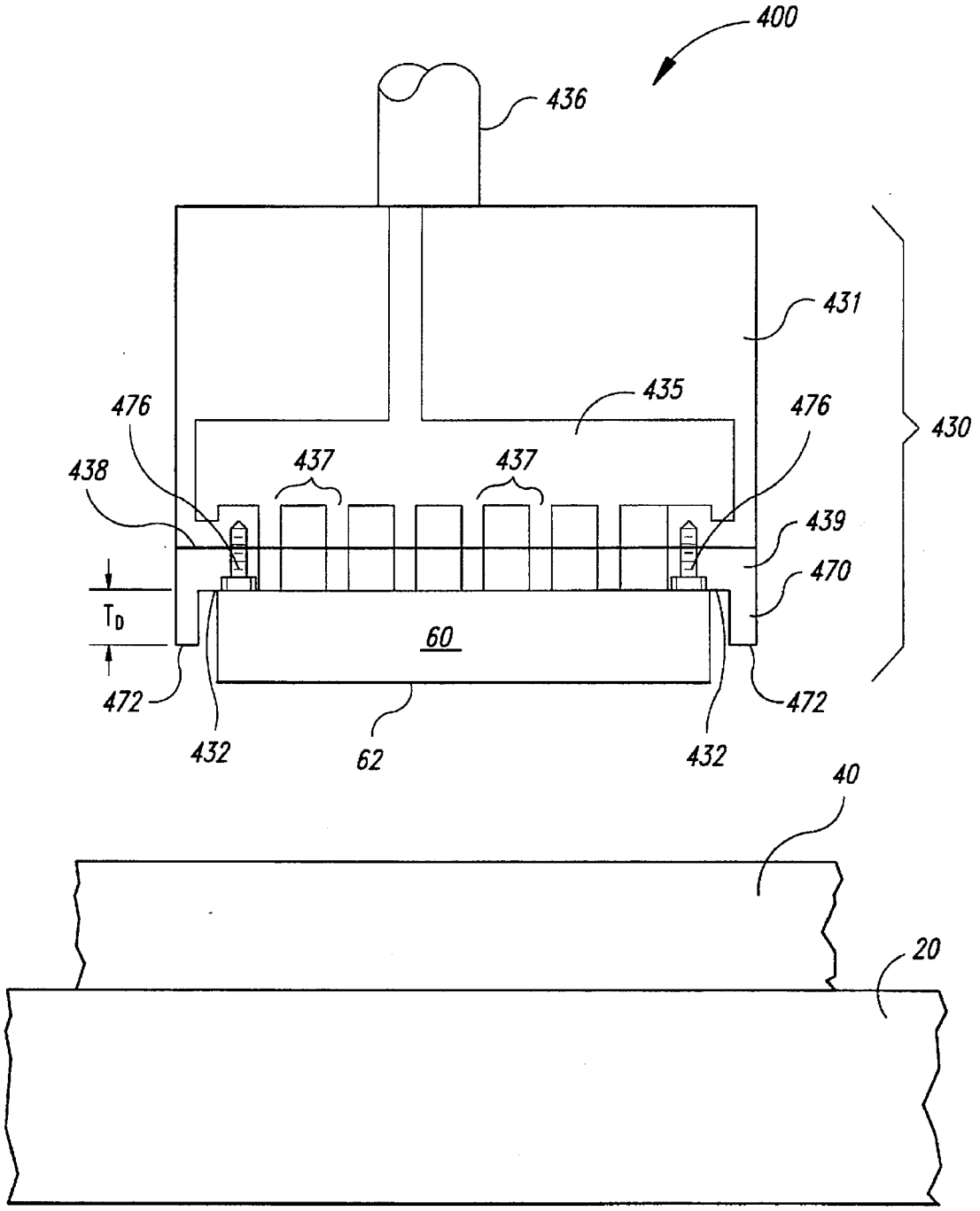
FIG. 5 is a cross-sectional view of another endpoint regulator in accordance with the invention.

FIG. 5 illustrates another endpoint regulator 400 that has a chuck 430 with a wafer carrier 431 and a removably attachable wafer holder 439. The wafer carrier 431 has a vacuum plenum 435 and a number of channels 437 that extend to the lower face 438 of the wafer carrier 431. The wafer holder 439 is preferably a plate with a wafer mounting surface 432 and a spacer 470 extending axially away from the wafer mounting surface 432. The spacer 470 is a rim with a polish-stop face 472 spaced apart from the wafer mounting surface 432 by a distance equal to the desired post-planarization thickness of the wafer $T_D$. The wafer holder 439 is removably attached to the wafer carrier 431 by a number of threaded bolts 476.

In operation, a series of wafer holders 439, each with a spacer 470 having a different axial length, may be interchanged with one another on the wafer carrier 431 to obtain the desired post-planarization thickness $T_D$ of the wafer 60. For example, to planarize the wafer 60 to a post-planarization thickness of 3 microns, the polish-stop face 472 of wafer holder 439 is axially spaced apart from the wafer mounting surface 432 by a distance of 3 microns. Similarly, to planarize another wafer to a post-planarization thickness of 2.5 microns, the polish-stop face on another wafer holder (not shown) is axially spaced apart from its wafer mounting surface by 2.5 microns. The endpoint regulator 400, therefore, enhances the flexibility of a single planarizing machine to accurately and quickly planarize different wafer designs to different desired post-planarization thicknesses.

Figure 6:
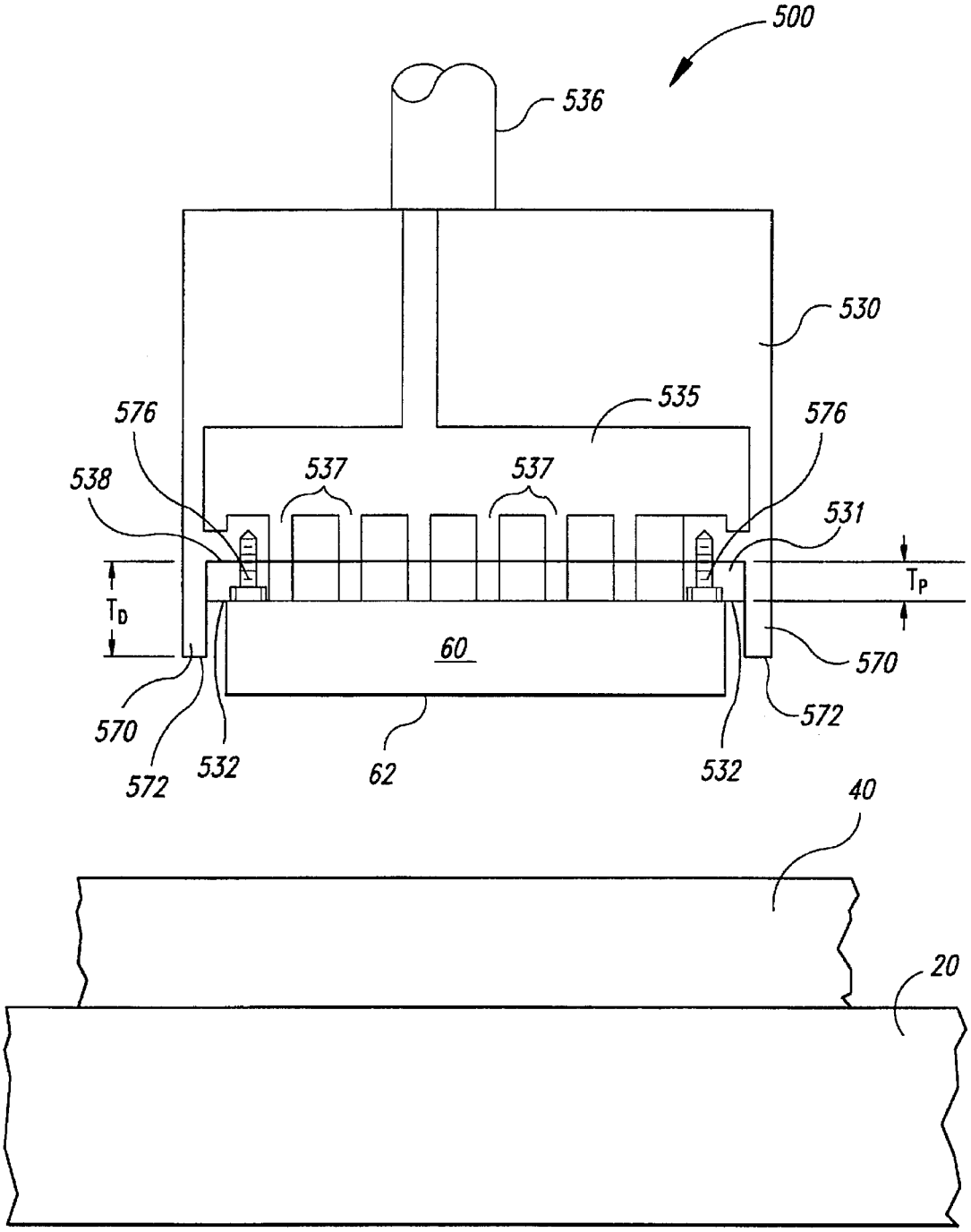
FIG. 6 is a cross-sectional view of another endpoint regulator in accordance with the invention.

FIG. 6 illustrates another endpoint regulator 500 that has a chuck 530 to which a backplate 531 is removably attached by a number of threaded bolts 576. The chuck 530 has a vacuum plenum 535 and a number of channels 537 that extend to the lower face 538 of the chuck 530. The backplate 531 is preferably a plate with a wafer mounting surface 532 that is spaced axially away from the lower face 538 of the chuck 530 by a distance $T_P$. A spacer 570, which is formed integrally with the chuck 530, extends axially away from the wafer mounting surface 532. The lower extremity of the spacer 570 is a polish-stop face 572 that is spaced apart from the wafer mounting surface 532 by a distance equal to the desired post-planarization thickness of the wafer $T_D$. In operation, a series of backplates 531, each having a different thickness $T_P$, may be interchanged with one another on the chuck 530 to obtain the desired post-planarization thickness $T_D$ of the wafer 60.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. An endpoint regulator for controlling the endpoint of a semiconductor wafer in semiconductor chemical-mechanical planarization processes, comprising:

a chuck having a mounting surface to which the wafer is attachable; and a spacer connected to the chuck and substantially surrounding the chuck around the periphery of the wafer, the spacer having a polish-stop face extending axially downwardly with respect to the mounting surface, wherein one of the polish-stop face or the mounting surface is selectively spaceable with respect to the other to space the polish-stop face apart from the mounting surface by a distance equal to a desired post-planarization thickness of the wafer, whereby the polish-stop face is adapted to engage a planarizing surface of a semiconductor polishing pad when the thickness of the wafer is substantially at the desired post-planarization thickness to substantially prevent further planarization of the wafer.

2. The endpoint regulator of claim 1 wherein the spacer comprises a removably attachable ring having an axial length between a reference point and the polish-stop face, the reference point on the ring being alignable with a guide point on the chuck to selectively space the polish-stop face apart from the mounting face by a distance equal to the desired thickness of the wafer.

3. The endpoint regulator of claim 2 wherein the spacer comprises a plurality of interchangeable rings with different axial lengths, each ring being separately removably attachable to the chuck, wherein a selected ring with an appropriate axial length is attached to the chuck to selectively space the polish-stop face on the selected ring apart from mounting surface by a distance equal to the desired wafer thickness.

4. The endpoint regulator of claim 1 wherein the spacer comprises an axially moveable sleeve, the sleeve being moveable axially with respect to the mounting surface to adjust the space between the mounting surface and the polish-stop face.

5. The endpoint regulator of claim 4 wherein the chuck has threads on an exterior surface and the sleeve has mating threads on an interior surface, the sleeve being axially moveable with respect to the chuck by rotating the sleeve around the chuck.

6. The endpoint regulator of claim 4 wherein an actuator has a housing attached to the chuck and a rod attached to the sleeve, the actuator telescopically moving the sleeve along the chuck to position the polish-stop face with respect to the mounting surface.

7. The endpoint regulator of claim 5, further comprising locking means to prevent the sleeve from rotating with respect to the chuck.

8. The endpoint regulator of claim 7 wherein the locking means comprises a locking ring threadedly attached to the chuck.

9. The endpoint regulator of claim 1 wherein the chuck comprises a wafer carrier and a separate wafer holder, the wafer holder being removably attachable to the wafer carrier, wherein the wafer mounting surface is formed on one side of the wafer holder and the spacer extends axially away from the wafer mounting surface.

10. The endpoint regulator of claim 1 wherein the wafer mounting surface is a lower face of a separate removably attachable backplate.

11. An endpoint regulator for controlling the endpoint of a semiconductor wafer in semiconductor chemical-mechanical planarization processes, comprising:

a chuck having a mounting surface to which the wafer is attachable;

a spacer connected to the chuck around the periphery of the wafer, the spacer having a polish-stop face extending axially downwardly with respect to the mounting surface, wherein one of the polish-stop face or the mounting surface is selectively spaceable with respect to the other to space the polish-stop face apart from the mounting surface by a distance equal to a desired post-planarization thickness of a wafer, whereby the polish-stop face is adapted to engage a planarizing surface of a semiconductor polishing pad when the thickness of the wafer is substantially at the desired post-planarization thickness to substantially prevent further planarization of the wafer; and a sensor attached to the spacer for generating a response signal when the polish-stop face engages the polishing pad.

12. The endpoint regulator of claim 11 wherein the sensor is a light emitter and a light detector, the light emitter directing a beam of light through a channel to the light detector, wherein the beam of light is interrupted when the polish-stop face engages the pad.

13. In chemical-mechanical planarization of semiconductor wafers, a method for regulating the endpoint of a wafer, comprising:

providing a spacer with an appropriate axial length between a reference point and a polish-stop face, the spacer surrounding substantially surround a chuck around the periphery of the wafer;

aligning the reference point on the spacer with a guide point on the chuck;

connecting the spacer to the chuck, the polish-stop face being positioned away from a mounting surface on the chuck by a distance equal to a desired post-planarization thickness of the wafer;

attaching the wafer to the chuck;

pressing the wafer against a polishing pad in the presence of a slurry; and moving at least one of the wafer and the polishing pad with respect to the other until the polish-stop face engages the polishing pad.

14. The method of claim 13, further comprising sensing when the polish-stop face engages the polishing pad.

15. In chemical-mechanical planarization of semiconductor wafers, a method for regulating the endpoint of a wafer, comprising the steps of:

providing a chuck having a spacer connected to the chuck and substantially surrounding the chuck around the periphery of the wafer;

moving the spacer axially with respect to the chuck to position a polish-stop face of the spacer apart from a wafer mounting surface of the chuck by a distance equal to a desired post-planarization thickness of the wafer;

attaching the wafer to the chuck;

pressing the wafer against a polishing pad in the presence of a slurry; and moving at least one of the wafer and the polishing pad with respect to the other until the polish-stop engages the polishing pad.

16. The method of claim 15 wherein the spacer and chuck are threadedly engaged with each other, the moving step comprising rotating the spacer with respect to the chuck to move the polish-stop face a predetermined distance.

17. The method of claim 15 wherein an axial actuator is attached to the chuck and the spacer, the moving step comprising axially moving a rod of the actuator against the spacer to move the polish-stop face a predetermined distance.

18. In chemical-mechanical planarization of semiconductor wafers, a method for regulating the endpoint of a wafer, comprising the steps of:

moving a spacer axially with respect to a chuck to position a polish-stop face of the spacer apart from a wafer mounting surface of the chuck by a distance equal to a desired post-planarization thickness of the wafer;

attaching the wafer to the chuck;

pressing the wafer against a polishing pad in the presence of a slurry;

moving at least one of the wafer and the polishing pad with respect to the other until the polish-stop face engages the polishing pad; and sensing when the polish-stop face engages the polishing pad by providing a sensor attached to the spacer and generating a response signal when the polish-stop face engages the polishing pad.

19. The method of claim 18 wherein the sensing step comprises directing a beam of light from a light emitter to a light detector so that the light beam is interrupted when the polish-stop face engages the pad, and indicating when the light beam is interrupted.

20. A planarizing machine for chemical-mechanical planarization of a semiconductor wafer, comprising:

a platen to which a polishing pad is attached;

a wafer chuck positioned opposite the polishing pad, the chuck having a mounting surface to which the wafer is attachable, wherein at least one of the chuck or the platen is movable with respect to the other to engage the wafer with the polishing pad and to impart motion between the wafer and the polishing pad; and a spacer connected to the chuck and substantially surrounding the chuck around the periphery of the wafer, the spacer having a polish-stop face extending axially downwardly with respect to the mounting surface, wherein one of the polish-stop face or the mounting surface is selectively spaceable with respect to the other space the polish-stop face apart from the mounting surface by a distance equal to a desired post-planarization thickness of the wafer, whereby the polish-stop face is adapted to engage a planarizing surface of the polishing pad when the thickness of the wafer is substantially at the desired post-planarization thickness to substantially prevent further planarization of the wafer.

21. The planarizing machine of claim 20, further comprising a wafer carrier and an actuator attached to the wafer carrier for moving the wafer carrier with respect to the platen, wherein the chuck is a separate unit attachable to the carrier.

22. The planarizing machine of claim 20 wherein the spacer comprises a removably attachable ring having an axial length between a reference point and the polish-stop face, the reference point on the ring being alignable with a guide point on the chuck to selectively space the polish-stop face apart from the mounting face by a distance equal to the desired thickness of the wafer.

23. The planarizing machine of claim 22 wherein the spacer comprises a plurality of interchangeable rings with different axial lengths, each ring being separately removably attachable to the chuck, wherein a selected ring with an appropriate axial length is attached to the chuck to selectively space the polish-stop face on the selected ring apart from mounting surface by a distance equal to the desired wafer thickness.

24. The planarizing machine of claim 20 wherein the spacer comprises an axially moveable sleeve, the sleeve being moveable axially with respect to the mounting surface to adjust the space between the mounting surface and the polish-stop face.

25. The endpoint regulator of claim 24 wherein the chuck has threads on an exterior surface and the sleeve has mating threads on an interior surface, the sleeve being axially moveable with respect to the chuck by rotating the sleeve around the chuck.

26. The planarizing machine of claim 24 wherein an actuator has a housing attached to the chuck and a rod attached to the sleeve, the actuator telescopically moving the sleeve along the chuck to position the polish-stop face with respect to the mounting surface.

27. The planarizing machine of claim 24, further comprising locking means to prevent the sleeve from rotating with respect to the chuck.

28. The planarizing machine of claim 27 wherein the locking means comprises a locking ring threadedly attached to the chuck.

29. The planarizing machine of claim 20 wherein the chuck comprises a wafer carrier and a separate wafer holder, the wafer holder being removably attachable to the wafer carrier, wherein the wafer mounting surface is formed on one side of the wafer holder and the spacer extends axially away from the wafer mounting surface.

30. The planarizing machine of claim 20, further comprising a sensor attached to the spacer for sensing when the polish-stop face engages the polishing pad.

31. The planarizing machine of claim 20 wherein the sensor is a light emitter and a light detector, the light emitter directing a beam of light through a channel to the light detector, wherein the beam of light is interrupted when the polish-stop face engages the pad.

* * * * *

UNITED STATES PATENT AND TRADEMARK OFFICE

CERTIFICATE OF CORRECTION

PATENT NO. : 5,643,048
DATED : July 1, 1997
INVENTOR(S) : Iyer

It is certified that error appears in the above-identified patent and that said Letters Patent is hereby corrected as shown below:

| | Reads | |
|---|---|---|
| Column 8, line 20 | "spacer surrounding substantially surround" | - - spacer substantially surrounding - - |

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*